US009648948B2

(12) United States Patent
Fish

(10) Patent No.: US 9,648,948 B2
(45) **Date of Patent: *May 16, 2017**

(54) WORK STATION

(71) Applicant: Scott A. Fish, Stafford, TX (US)

(72) Inventor: Scott A. Fish, Stafford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/968,608

(22) Filed: Dec. 14, 2015

(65) Prior Publication Data

US 2016/0095427 A1 Apr. 7, 2016

Related U.S. Application Data

(63) Continuation of application No. 14/094,540, filed on Dec. 2, 2013, now Pat. No. 9,241,562.

(51) Int. Cl.

| | |
|---|---|
| ***A47B 37/00*** | (2006.01) |
| ***A47B 21/04*** | (2006.01) |
| ***A47B 21/02*** | (2006.01) |
| ***A47B 21/03*** | (2006.01) |

(52) U.S. Cl.

CPC ..... *A47B 21/04* (2013.01); *A47B 21/02* (2013.01); *A47B 21/0314* (2013.01); *A47B 2021/0321* (2013.01); *A47B 2200/0088* (2013.01)

(58) Field of Classification Search

CPC .. A47B 9/00; A47B 9/02; A47B 21/00; A47B 21/04; A47B 21/02; A47B 2200/0076

USPC ..... 108/50.01, 145, 147, 147.11, 144.11, 108/147.16, 7; 312/223.3, 223.1, 195, 312/196, 194

See application file for complete search history.

(56) References Cited

U.S. PATENT DOCUMENTS

| | | | |
|---|---|---|---|
| 2,170,098 | A | 8/1939 | Stephenson |
| 2,982,050 | A | 5/1961 | May |
| 4,747,353 | A | 5/1988 | Watt |
| 4,817,220 | A | 4/1989 | Guttormsem |
| 4,852,500 | A | 8/1989 | Ryurg et al. |
| 4,898,103 | A | 2/1990 | Pontoppidan |
| 5,101,736 | A | 4/1992 | Bommarito |
| 5,174,223 | A | 12/1992 | Nagy et al. |
| 5,322,025 | A | 6/1994 | Sherman |
| 5,398,622 | A | 3/1995 | Lubinskas et al. |

(Continued)

FOREIGN PATENT DOCUMENTS

| | | |
|---|---|---|
| CN | 612839 | 8/1979 |

OTHER PUBLICATIONS

USPTO Office Action for U.S. Appl. No. 14/283,152 dated Jul. 15, 2014.

(Continued)

*Primary Examiner* — Jose V Chen
(74) *Attorney, Agent, or Firm* — Tumey L.L.P.

(57) ABSTRACT

A work station includes a work surface and a panel with a notch formed therein and a channel formed therethrough. A panel support base is positioned within the notch of the panel, a sliding member is positioned within the channel of the panel and extends through the work surface, a support member is positioned at an end portion of the sliding member extending through the work surface, and an arm rotatably coupled between the panel support base and the sliding member. The arm is rotatable to move the sliding member and adjust the position of the support member relative to the work surface.

20 Claims, 7 Drawing Sheets

(56) References Cited

U.S. PATENT DOCUMENTS

| | | | |
|---|---|---|---|
| 5,437,235 | A | 8/1995 | Randolph |
| 5,461,974 | A | 10/1995 | Reneau |
| 5,522,323 | A | 6/1996 | Richard |
| 5,526,756 | A | 6/1996 | Watson |
| 5,758,849 | A | 6/1998 | Bui et al. |
| 5,778,799 | A | 7/1998 | Eyre |
| 5,791,259 | A | 8/1998 | Mansfield |
| 5,845,587 | A | 12/1998 | Ditonto |
| 5,953,776 | A | 9/1999 | Sanders et al. |
| 6,038,986 | A | 3/2000 | Ransil et al. |
| 6,712,008 | B1 | 3/2004 | Habenicht |
| 6,722,673 | B1 | 4/2004 | Hamlin |
| 7,207,278 | B2 | 4/2007 | Latino et al. |
| 7,398,738 | B2 | 7/2008 | Newhouse |
| 7,584,705 | B2 | 9/2009 | Chen |
| 7,922,267 | B2 | 4/2011 | Gevaert |
| 8,065,966 | B1 | 11/2011 | Bacon et al. |
| 8,789,474 | B2 | 7/2014 | Kim |
| 9,161,617 | B2 * | 10/2015 | Fish ..... A47B 21/02 |
| 9,241,562 | B2 * | 1/2016 | Fish ..... A47B 21/02 |
| 2006/0000955 | A1 | 1/2006 | Cvek |
| 2006/0174807 | A1 | 8/2006 | Dral |
| 2007/0266912 | A1 | 11/2007 | Swain |
| 2008/0060560 | A1 | 3/2008 | Chen |

OTHER PUBLICATIONS

USPTO Final Office Action for U.S. Appl. No. 14/283,152 dated Nov. 13, 2014.

USPTO Notice of Allowance for U.S. Appl. No. 14/283,152 dated Jun. 11, 2015.

USPTO Office Action for U.S. Appl. No. 14/094,540 dated Mar. 17, 2015.

USPTO Final Office Action for U.S. Appl. No. 14/094,540 dated Jun. 22, 2015.

USPTO Notice of Allowance for U.S. Appl. No. 14/094,540 dated Sep. 14, 2015.

* cited by examiner

WORK STATION

CROSS-REFERENCE TO RELATED APPLICATIONS

This application is a continuation application of U.S. patent application Ser. No. 14/094,540 filed Dec. 2, 2013, which is incorporated by reference herein in its entirety.

BACKGROUND

The advent of computers as an integral element of modern day society has meant that many people are using a computer on a fairly regular basis, either at home as a hobby, or at work, where the computer is used as a business tool. Currently, such computers consist of a number of discrete elements which make up a work station, and which typically include a video display monitor, a CPU/disk-drive cabinet, (also referred to herein as a computer) which typically has a disk drive located at one end, and also usually houses the central processing unit (or CPU), and a keyboard.

Many attempts have been made to design an efficient desk or cabinet to house the computer work station. In most such prior attempts, the video display monitor is mounted on top of the CPU/disk-drive cabinet, which in turn is mounted upon a horizontal shelf surface, such as a desk top. Typically, the depth of the CPU/disk-drive cabinet, together with the space required for the electrical plugs at the rear of the cabinet, is such that there is little room left in front of the cabinet on conventional desks. Consequently, a lower outwardly extending shelf is sometimes provided, to support the keyboard.

However, the foregoing arrangement is inefficient, and awkward to use. For example, in the airline industry, in which computer podiums and kiosks are frequently used for purposes of checking passengers and baggage, it may be difficult to adjust components of the podium or kiosk to account for the variety of users that are expected to interact with the computer at the podium or kiosk. Accordingly, it remains a priority to increase the flexibility of these systems to be more user-friendly.

BRIEF DESCRIPTION OF THE DRAWINGS

For a detailed description of the preferred embodiments of the invention, reference will now be made to the accompanying drawings in which.

DETAILED DESCRIPTION

Figure 1:
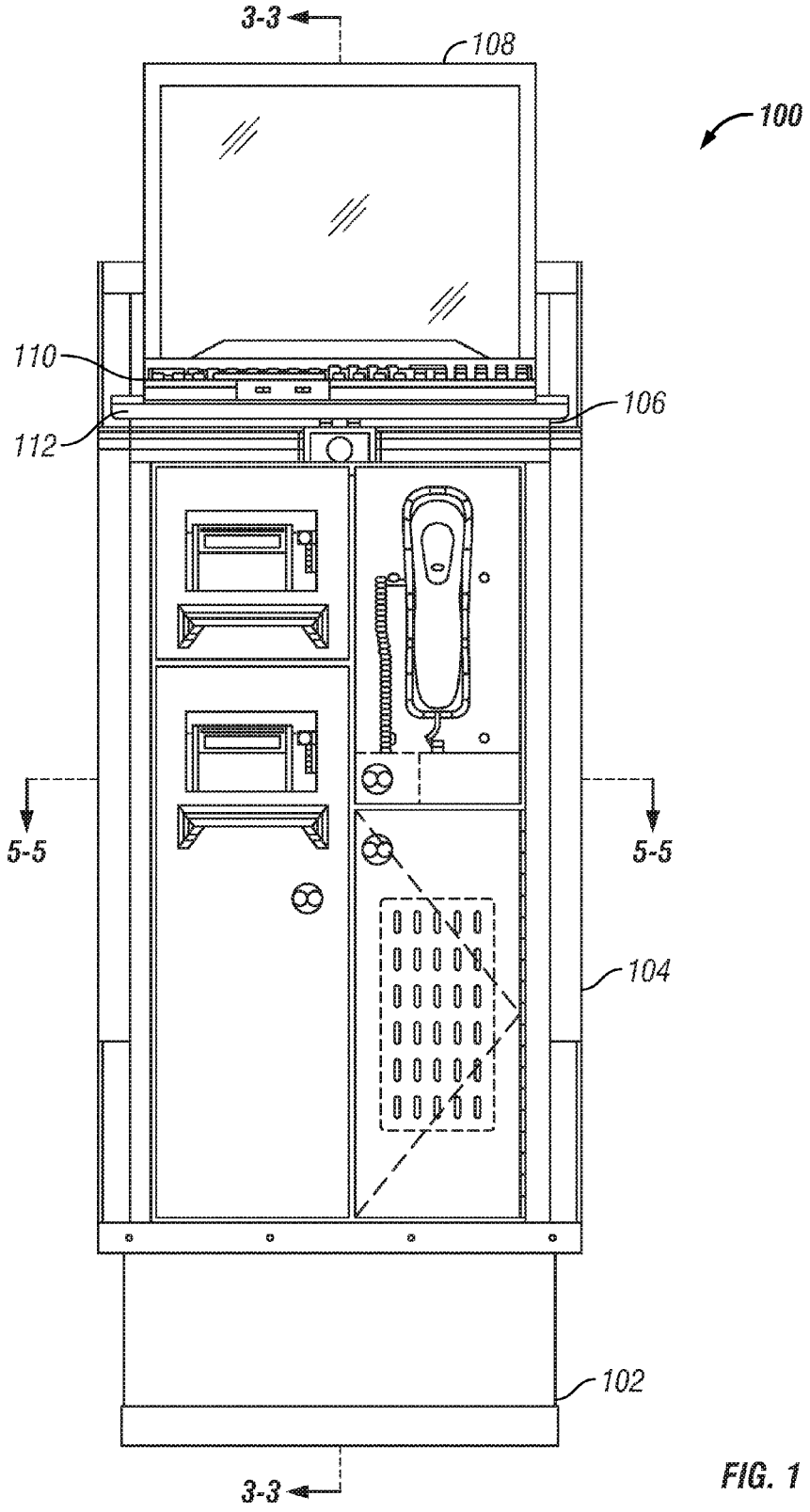
FIG. 1 shows a front perspective view of a work station in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, the present disclosure relates to a work station, such as a computer work station, in which the work station is to include a movable support member therein. The work station may include a panel that is to be positioned within the work station, with the panel including a notch formed therein and a channel formed therethrough. A base is then positioned within the notch of the panel, and a sliding member is positioned within the channel of the panel. A support member is then positioned at an end of the sliding member, thereby enabling the work station to include a movable support member therein. Further, an arm is rotatably coupled between the base and the sliding member.

Figure 2:
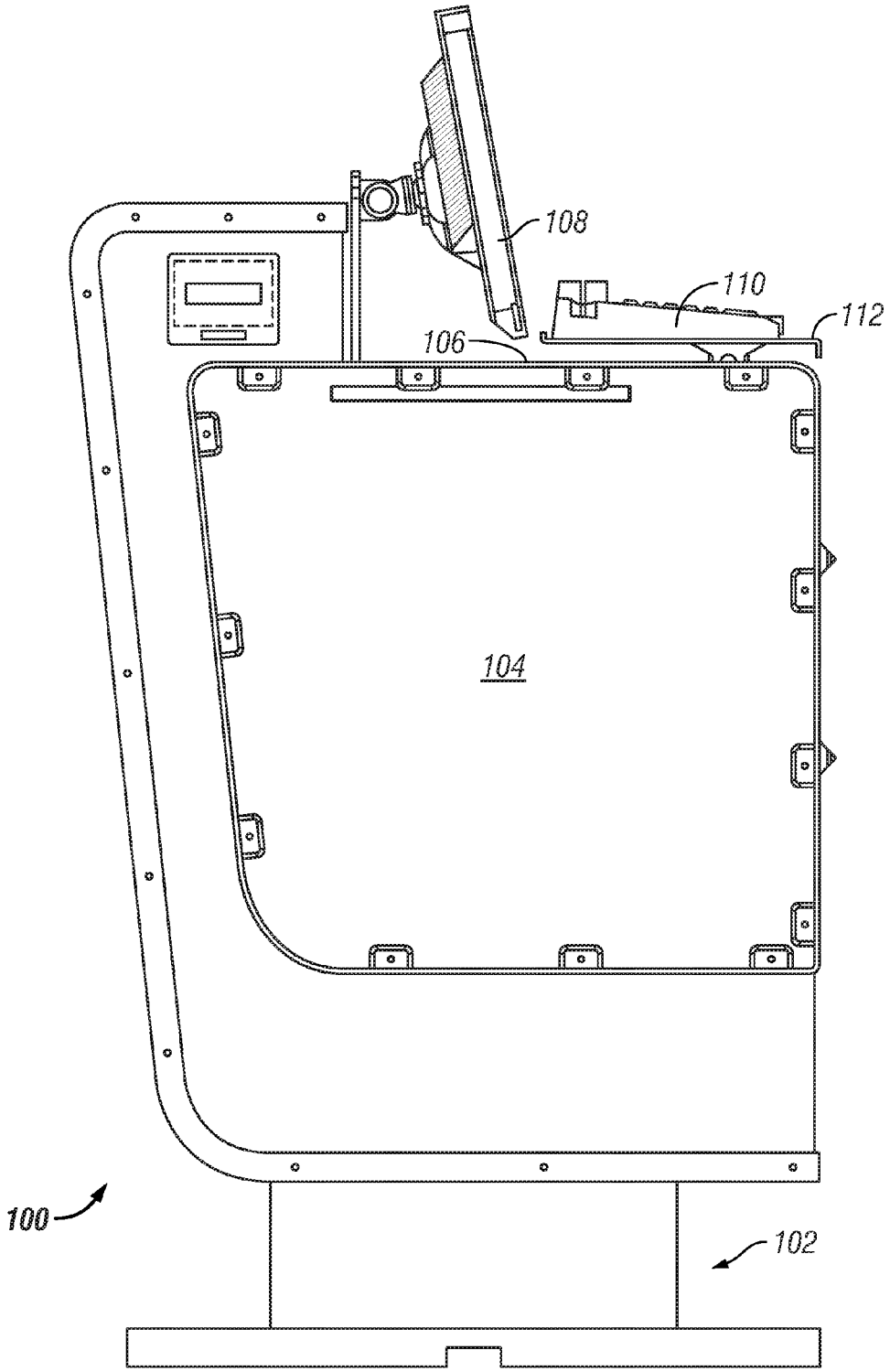
FIG. 2 shows a side perspective view of a work station in accordance with one or more embodiments of the present disclosure.
Figure 3:
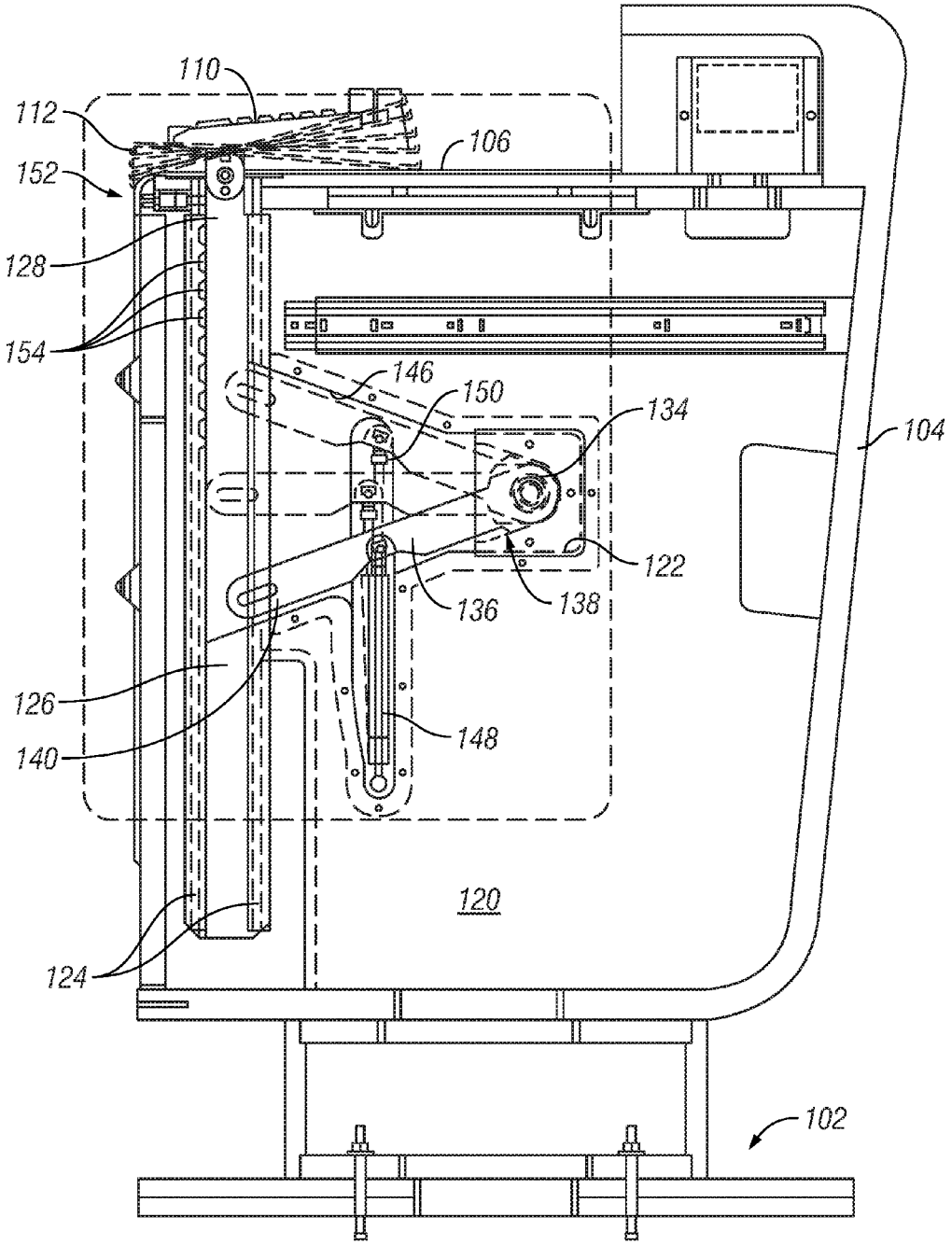
FIG. 3 shows a cross-sectional view of the work station taken along line 3-3 in FIG. 1 in accordance with one or more embodiments of the present disclosure.
Figure 4:
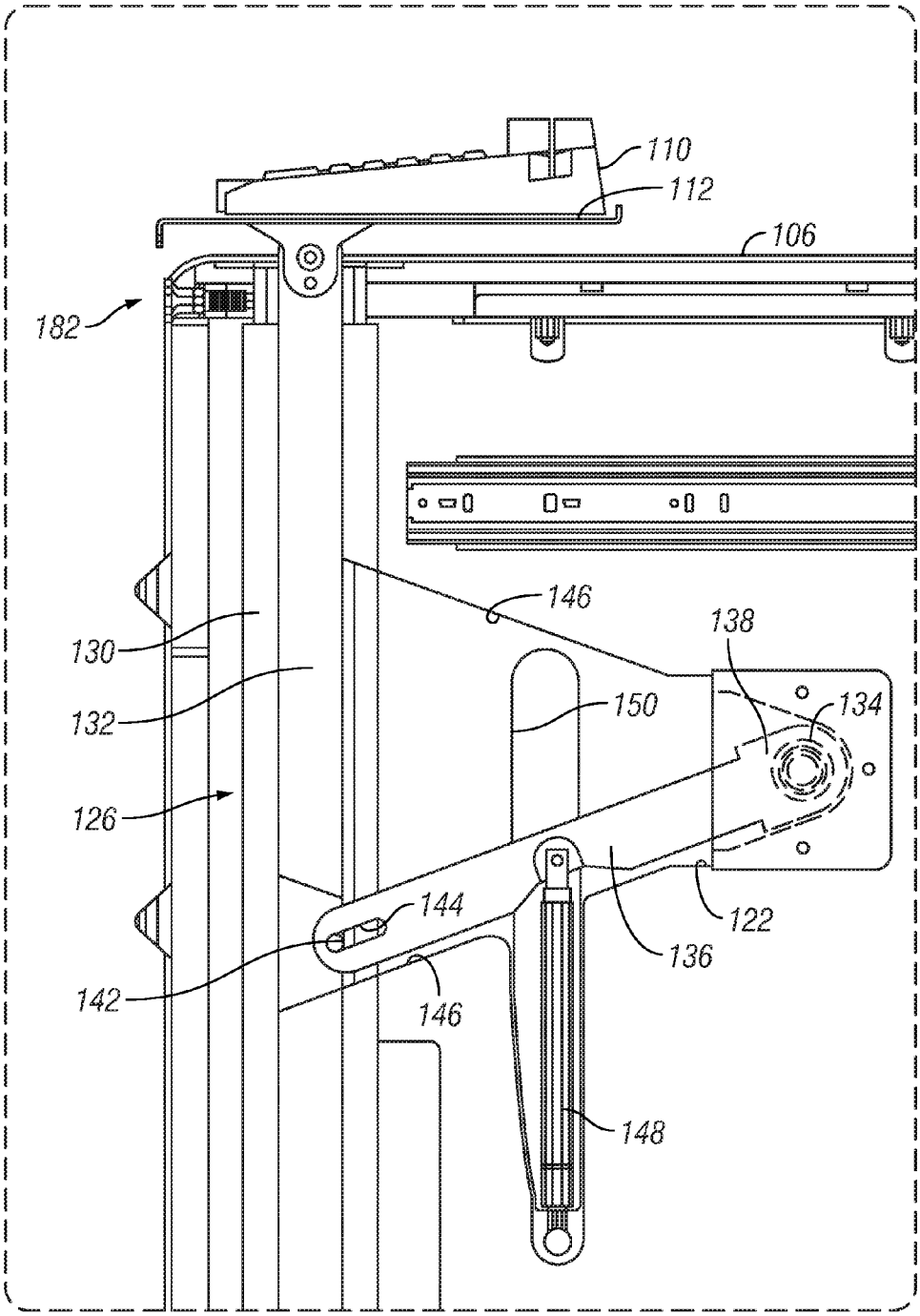
FIG. 4 shows a detailed view of the work station in FIG. 3 in accordance with one or more embodiments of the present disclosure.
Figure 5:
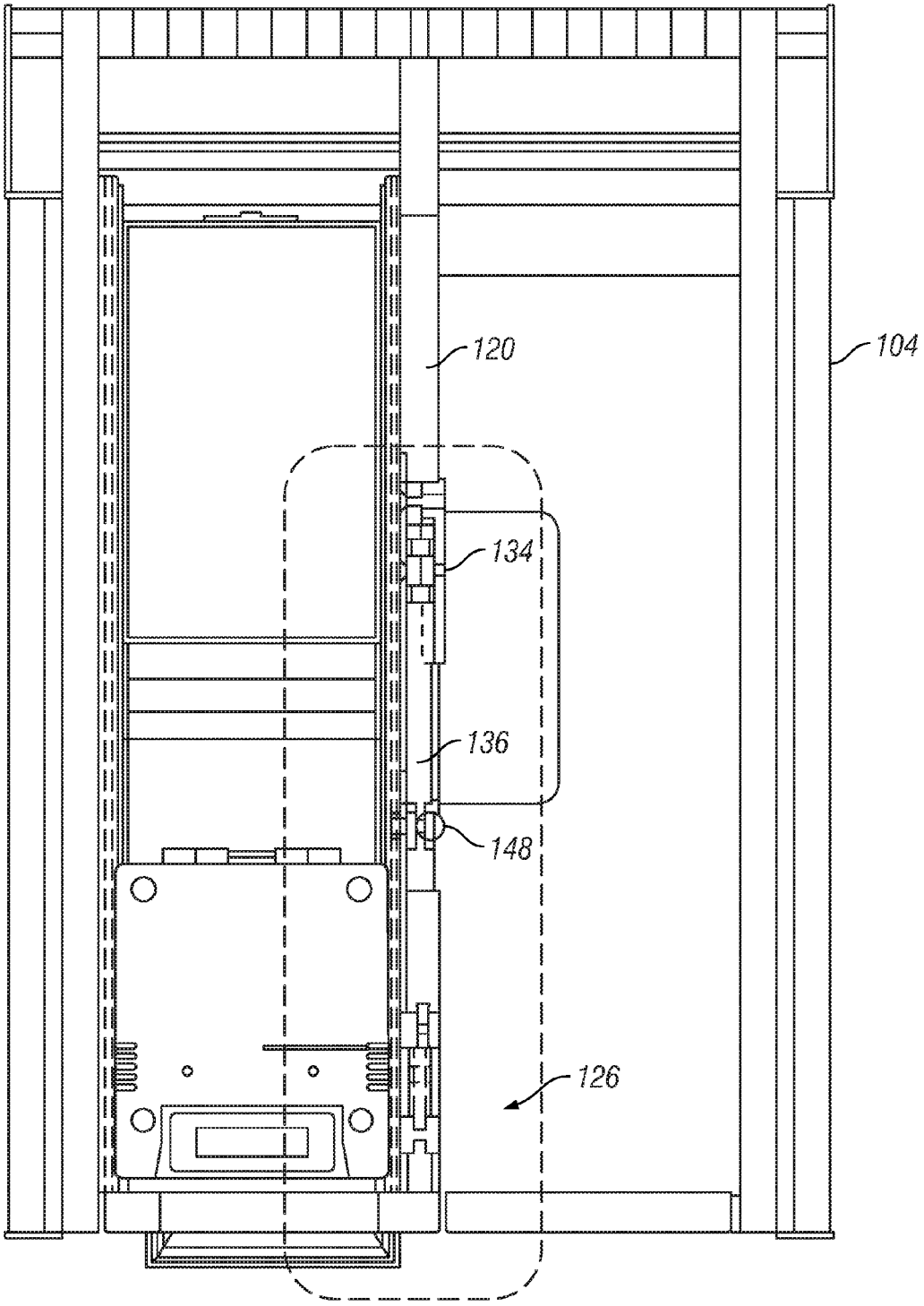
FIG. 5 shows a cross-sectional view of the work station taken along line 5-5 in FIG. 1 in accordance with one or more embodiments of the present disclosure.
Figure 6:
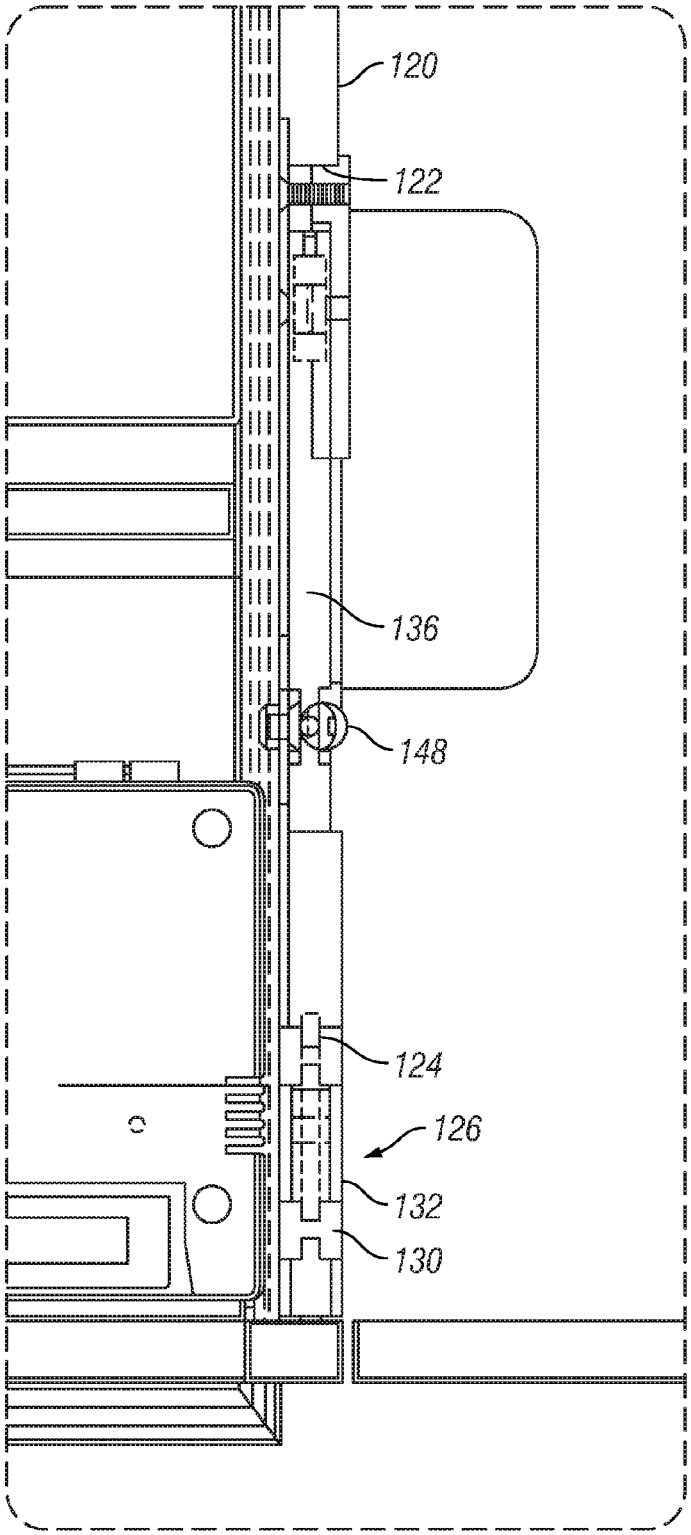
FIG. 6 shows a detailed view of the work station shown in FIG. 5 in accordance with one or more embodiments of the present disclosure.

Referring now to FIGS. 1-6, multiple views of a work station 100 in accordance with one or more embodiments of the present disclosure are shown. FIG. 1 shows a front perspective view of the work station 100; FIG. 2 shows a side perspective view of the work station 100; FIG. 3 shows a cross-sectional view of the work station 100 taken along line 3-3 in FIG. 1; FIG. 4 shows a detailed view of the work station 100 in FIG. 3; FIG. 5 shows a cross-sectional view of the work station 100 taken along line 5-5 in FIG. 1; and FIG. 6 shows a detailed view of the work station 100 shown in FIG. 5.

The work station 100 may be a computer work station, and more particularly may be a computer work station for use within the airline industry. For example, during ticketing, check-in, or baggage claim procedures frequently conducted at an airport, the work station 100 may be used to increase the flexibility of the computer system to be more user-friendly. As such, in accordance with one or more embodiments, the work station 100 may be used to house a computer and/or computer components therein. For example, the work station 100 may be used to house a computer therein, in addition to a keyboard, printer, monitor, and/or any other components frequently used with a computer. However, the work station 100 is not so limited to only be used with computers and/or in the airline industry, and in fact may be used in any circumstance or industry that may benefit in increasing the flexibility of a work space or a work station.

Accordingly, the work station 100 may include a base 102 used to support and secure the work station 100 to a floor. The work station 100 may further include a housing body 104, in which the housing body 104 may include one or more compartments formed therein, such as to house various components within the one or more compartments. For example, the housing body 104 may include one compartment to house computer hardware, such as house a computer tower including the computer data storage, hard drive disk, and/or system processor. Further, the housing body 104 may include another compartment to house computer accessories, such as to house a printer that is usable with the computer. The housing body 104 may alternatively house different types of components therein, depending on the specific use or industry for the work station.

The work station 100 may further include a work surface 106. The work surface 106 may be defined as the surface of the work station 100 above the housing body 104, in which a user interacting with the work station 100 may interact with components, such as computer components, positioned on or adjacent to the work surface 106. For example, a monitor 108 and a keyboard 110 may be connected and work in conjunction with a computer housed within the work station 100. As such, the monitor 108 and the keyboard 110 may be positioned on or adjacent the work surface 106 of the work station 100.

In particular, the work station 100 may include a support member 112, in which the support member 112 may be positioned adjacent the work surface 106 and extend above and over the work surface 106. Further, the support member 112 may be movable within the work station 100, such as by having the support member 112 movable with respect to the work surface 106. For example, in accordance with one or more embodiments, the support member 112 may be able to move vertically towards and away the work surface 106. Further, the support member 112 may be able to rotate with respect to the work surface 106. As such, the keyboard 110 may be supported by the support member 112, in which the keyboard 110 may be moved with respect to the work surface 106 based upon a desired configuration.

Accordingly, as best shown in FIGS. 3 and 4, the work station 100 may include a panel 120 positioned therein, such as by having the panel 120 positioned vertically within the housing body 104. The panel 120 may be positioned substantially in the center of the housing body 104, or alternatively be positioned closer to either of the sides of the housing body 104.

Accordingly, to increase the space efficiency of the work station 100, the panel 120 may have one or more portions removed therefrom. For example, as shown in FIGS. 3-6, the panel 120 may have a notch 122 formed therein, such as extending into a surface of the panel 120, and may have a channel 124 formed therethrough, such as extending across and through both surfaces of the panel 120. The notch 122 and the channel 124 are shown in phantom in FIG. 3.

A sliding member 126 may be positioned within the channel 124 of the panel 120, in which the sliding member 126 may be slidable and movable within the channel 124. Further, the sliding member 126 may have an end portion 128 thereof that may extend into the work surface 106 of the work station 100. As such, the support member 112 may be positioned at the end portion 128 of the sliding member 126 such that the support member 112 (along with any components supported by the support member 112) may be able to move along with the sliding member 126. Accordingly, in one or more embodiments, the support member 112 may be a keyboard support member.

The support member 112 may be rotatably coupled to the end portion 128 of the sliding member 126. For example, as shown in phantom in FIG. 3, the support member 112 may be rotatable into and out of a plane that is parallel with the work surface 106. Additionally or alternatively, the support member 112 may be rotatable along a plane that is parallel with the work surface 106. With respect to FIG. 3, rotatable motion of the support member 112 may enable a user to rotate the keyboard 110 supported thereon for a desired level of comfort, particularly when using the keyboard 106 in conjunction with the monitor 108. Additionally or alternatively, rotatable motion of the support member 112 may enable or prevent access to the work surface 106. For example, in a scenario in which the keyboard 106 may not be in use, the support member 112 may be rotated along a plane in parallel with the work surface 106, such as to move the support member 112 from directly above the work surface 106 to extend out away from and beyond the work surface 106 to enable access to the work surface 106. Accordingly, the present disclosure is not so limited to the rotational motion of the support member 112 with respect to the sliding member 126, as shown in FIG. 3, as the present disclosure contemplates additional types of motion also for the support member 112.

In accordance with one or more embodiments, the sliding member 126 may include one or more components, such as one or more guide rails 130 and a sliding base 132. For example, the guide rail 130 may be positioned within the channel 124 of the panel 120, such as by having a guide rail 130 positioned on each side of the channel 124, and the sliding base 132 may be positioned within or between the guide rails 130 in the channel 124. Accordingly, the sliding base 132 may be slidable between an uppermost position and a lowermost position with respect to the guide rail 130. In FIGS. 3 and 4, the sliding base 132 is shown in the lowermost position. However, the sliding base 132 may slidably move within the guide rails 130 upward to move into the uppermost position. As such, the support member 112 may be movable with the sliding base 132, as the support member 112 may be coupled to the sliding base 132. The sliding member 126 may have a range-of-motion of about eight inches (about 20.3 centimeters). As such, the support member 112, and any components supported thereon, may be movable within the range-of-motion of the sliding member 126.

Referring still to FIGS. 3-6, the work station 100 may include a panel support base 134 and an arm 136, in which the arm 136 may be rotatably coupled between the panel support base 134 and the sliding member 126. The panel support base 134 may be positioned within the notch 122 of the panel 120. The arm 136 may include an end portion 138 that is rotatably coupled to the panel support base 134, thereby enabling the arm 136 to rotate with respect to the panel support base 134. Further, the arm 136 may include another end portion 140 that is rotatably coupled to the sliding member 126, thereby enabling the arm 136 to rotate with respect to the sliding member 126. Accordingly, the arm 136 may rotate and travel with the sliding member 126 as the sliding member 126 moves within the channel 124.

In the embodiment shown in FIGS. 3 and 4, to rotatably couple the arm 136 to the sliding member 126, a pin-and-slot device may be used. For example, the sliding member 126 may include a pin 142, and the end portion 140 of the arm 136 may include a groove 144 formed therein. As such, the pin 142 may be slidably received within the groove 144, thereby enabling the arm 140 to rotate with and move relative to the sliding member 126. Alternative devices may be used to rotatably couple the arm to the sliding member and/or the panel support base. For example, in one embodiment, the arm may include the pin and the sliding member may include the groove. Accordingly, the present disclosure contemplates other arrangements and configurations than those shown to rotatably couple the arm between the sliding member and the panel support base.

The panel 120 may include a pathway 146 formed therein. For example, the pathway 146 may be formed into a surface of the panel 120, in which the arm 136 may be received, recessed, and/or movable within the pathway 146 of the panel 120. As shown, the arm 136 extends between the sliding member 126 and the panel support base 134. As such, the pathway 146 may extend between the channel 124 that receives the sliding member 126 and the notch 122 that receives the panel support base 134. Further, as the arm 136 may travel and move as the sliding member 126 moves between the uppermost and lowermost positions, the pathway 146 may be formed within the panel 120 to accommodate for this movement of the arm 136 between the uppermost and lowermost positions.

Referring to FIGS. 3-6, the work station 100 may include a dampening mechanism 148. The dampening mechanism 148 may be used to dampen movement of the sliding member 126. For example, when the sliding member 126 is moving from the uppermost position and the lowermost position, or vice-versa, the dampening mechanism 148 may be used to dampen movement to reduce the energy or speed of the sliding member 126, the support member 112 connected to the sliding member 126, and any component supported by the support member 112. The dampening mechanism 148 may be coupled directly or indirectly to the sliding member 126. For example, as shown the dampening mechanism 148 may be indirectly coupled to the sliding member 126 by having the dampening mechanism 148 coupled to the arm 136, with the arm 136 coupled to the sliding member 126.

The panel 120 may include a slot 150 formed therethrough. As such, the dampening mechanism 148, which is shown to be a piston in FIGS. 3-6, may be positioned within the slot 150 of the panel 120. As the dampening mechanism 148 is shown as coupled to the arm 136, the slot 150 that the dampening mechanism 148 is positioned in may be formed adjacent and/or within the pathway 146 for the arm 136. Accordingly, the dampening mechanism 148 in this embodiment may be rotatably coupled to the panel 120 at the end of the slot 150.

Figure 7:
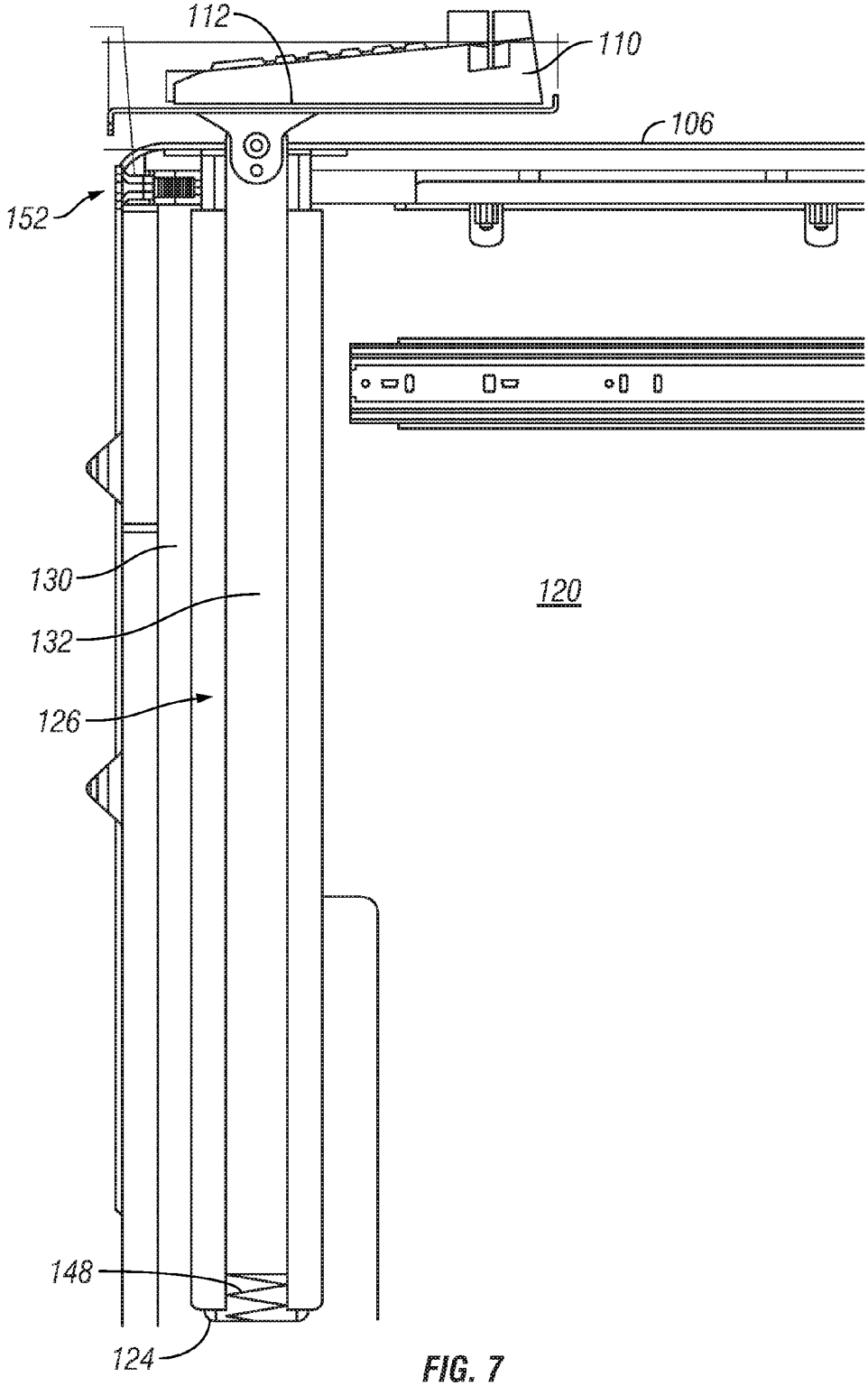
FIG. 7 shows a side perspective view of a panel of a work station in accordance with one or more embodiments of the present disclosure.

The present disclosure contemplates other forms, types, arrangements, and configurations for a dampening mechanism in accordance with the present disclosure. For example, as shown in FIG. 7, another example of a dampening mechanism in accordance with the present disclosure is shown. In this embodiment, the dampening mechanism 148 may be a spring, in which the spring may be used to dampen movement of the sliding member 126. The spring may be directly or indirectly coupled to the sliding member 126. For example, in this embodiment, the spring may be positioned within the channel 124, such as at the bottom of the channel 124, in which the spring may dampen the movement of the sliding member 126 as the sliding member 126 moves towards and into engagement with the spring, such as when in the lowermost position. Accordingly, other types of dampening mechanisms, along with other arrangements for dampening mechanisms, may be used without departing from the scope of the present disclosure.

Referring to FIGS. 3 and 4, the work station 100 may include a locking mechanism 152. The locking mechanism 152 may be used to lock or hold the sliding member 126 in a position with respect to the panel 120, such as to lock the sliding member 126 in the uppermost position, the lowermost position, or some position therebetween. For example, as shown particularly in FIG. 3, the sliding member 126, such as in particular the sliding base 132 of the sliding member 126, may include a plurality of notches 154 formed therein. The locking mechanism 152 may include a pin, such as a spring loaded pin, in which the pin of the locking mechanism may engage one of the notches 154. As the pin of the locking mechanism 152 may be received within and engage one of the notches 154, this engagement may prevent any further movement of the sliding member 126. Further, the locking mechanism 152 may be movable between an engaged (locked) position and a disengaged (unlocked) position. In the engaged position, the locking mechanism 152 may be used to lock or hold the sliding member 126 in the position with respect to the panel 120. In the disengaged position, the locking mechanism 152 may allow the sliding member 126 to move and slide with respect to the panel 120. As such, as the locking mechanism 152 may be a spring loaded pin, the pin may be biased towards the engaged position. Alternatively, in one or more embodiments, the pin may be biased towards the disengaged position.

A panel in accordance with the present disclosure may have standard dimensions common with the industry, such as standard dimensions common for panels included within work stations or desks, and/or standard dimensions common for panels used within the airline industry. As such, in one or more embodiments, the panel may have a thickness of about 0.5 inches (about 1.27 centimeters). Accordingly, the components used with a panel of the present disclosure may have similar dimensions such as to adequately be used and incorporated within a work station of the present disclosure.

As discussed above, the work station 100 may include the panel 120 positioned vertically and substantially within the center of the housing body 104. However, the present disclosure is not so limited, as the panel 120 may have an orientation other than vertical. Further, the panel 120 may be positioned closer to either of the sides of the housing body 104, as opposed to positioned within the middle of the housing body 104. Furthermore, a work station in accordance with the present disclosure may include multiple panels, such as by having multiple sliding members for use with one or more support members. Accordingly, the present disclosure contemplates other arrangements and configurations for a work station that are not necessarily specifically shown or discussed with respect to the above embodiments.

Although the present invention has been described with respect to specific details, it is not intended that such details should be regarded as limitations on the scope of the invention, except to the extent that they are included in the accompanying claims.

What is claimed is:

1. A work station comprising:

a work surface;

a panel including a notch formed therein and a channel formed therethrough;

a sliding member positioned within the channel of the panel and extending through the work surface; and a locking mechanism configured to lock the sliding member in position with respect to the panel, wherein the sliding member comprises a plurality of notches formed therein, and wherein the locking mechanism comprises a pin configured to engage one of the plurality of notches to lock the sliding member in the position with respect to the work surface.

2. The work station of claim 1, wherein the sliding member comprises a guide rail and a sliding base, wherein the guide rail is positioned within the channel of the panel and the sliding base is positioned within the guide rail, and wherein the sliding base is slidable between an uppermost position and a lowermost position with respect to the guide rail.

3. The work station of claim 1, further comprising a support member positioned at an end portion of the sliding member extending through the work surface, wherein the support member is rotatably coupled to the end portion of the sliding member, and wherein the support member comprises a keyboard support member.

4. The work station of claim 1, further comprising a dampening mechanism engaged with the sliding member.

5. The work station of claim 4, wherein the dampening mechanism is coupled to an arm, and wherein the dampening mechanism is positioned within a slot formed through the panel.

6. The work station of claim 4, wherein the dampening mechanism comprises at least one of a piston and a spring.

7. The work station of claim 1, wherein the sliding member comprises a pin and an arm comprising a slot, and wherein the pin of the sliding member is slidably received within the slot of the arm.

8. The work station of claim 1, further comprising a support member positioned at an end portion of the sliding member extending through the work surface.

9. The work station of claim 1, further comprising an arm rotatably coupled between a panel support base and the sliding member, wherein the arm is rotatable to move the sliding member and adjust the position of a support member relative to the work surface.

10. A system for a work station, the system comprising:

a work surface;

a panel support base;

a sliding member, wherein the sliding member comprises a guide rail and a sliding base,;

an arm rotatably coupled between the panel support base and the sliding member; and wherein the arm is rotatable to move the sliding member.

11. The system of claim 10, further comprising a support member, wherein the support member is rotatably coupled to an end portion of the sliding member; wherein the support member comprises a keyboard support member.

12. The system of claim 10, further comprising a dampening mechanism engaged with either the sliding member or the arm and configured to dampen movement of the sliding member.

13. The system of claim 12, wherein the dampening mechanism is coupled to the arm.

14. The system of claim 12, wherein the dampening mechanism comprises at least one of a piston and a spring.

15. The system of claim 10, further comprising a locking mechanism engageable with the sliding member and configured to lock the sliding member in a position with respect to the work surface.

16. The system of claim 10, wherein the sliding member comprises a pin and the arm comprises a slot formed therein, and wherein the pin of the sliding member is slidably received within the slot of the arm.

17. The system of claim 10, wherein:

an end portion of the arm is rotatably coupled to the panel support base; and another end portion of the arm is rotatably coupled to the sliding member.

18. A panel for a work station comprising a work surface, the panel comprising:

a notch formed therein and a channel formed therethrough;

a panel support base positioned within the notch of the panel;

a sliding member positioned within the channel of the panel and extendable through the work surface; and a support member positionable at an end portion of the sliding member extendable through the work surface.

19. The panel of claim 18, wherein the sliding member comprises a guide rail and a sliding base, wherein the guide rail is positioned within the channel of the panel and the sliding base is positioned within the guide rail, and wherein the sliding base is slidable between an uppermost position and a lowermost position with respect to the guide rail.

20. The panel of claim 18, wherein the support member is rotatably coupled to the end portion of the sliding member, and wherein the support member comprises a keyboard support member.

* * * * *